US007762170B2

(12) United States Patent
Yamada et al.

(10) Patent No.: US 7,762,170 B2
(45) Date of Patent: Jul. 27, 2010

(54) HEAT-EFFECT REDUCEABLE FINISHING UNIT AND IMAGE FORMING SYSTEM USING THE SAME

(75) Inventors: Kenji Yamada, Kanagawa (JP); Hiromoto Saitoh, Tokyo (JP); Naohiro Kikkawa, Tokyo (JP); Junichi Iida, Kanagawa (JP); Junichi Tokita, Kanagawa (JP); Shingo Matsushita, Kanagawa (JP)

(73) Assignee: Ricoh, Co. Ltd., Tokyo (JP)

( * ) Notice: Subject to any disclaimer, the term of this patent is extended or adjusted under 35 U.S.C. 154(b) by 400 days.

(21) Appl. No.: 11/519,039

(22) Filed: Sep. 12, 2006

(65) Prior Publication Data

US 2007/0056423 A1 Mar. 15, 2007

(30) Foreign Application Priority Data

Sep. 12, 2005 (JP) ..... 2005-263896
Jun. 13, 2006 (JP) ..... 2006-163562

(51) Int. Cl.
*B26F 1/14* (2006.01)

(52) U.S. Cl. ..... 83/171; 83/449; 83/686

(58) Field of Classification Search ..... 83/669, 83/405, 167, 449, 686, 687, 691, 171; 270/58.07
See application file for complete search history.

(56) References Cited

U.S. PATENT DOCUMENTS 2,244,660 A * 6/1941 Carpenter ..... 83/167
4,527,473 A 7/1985 Littleton
4,713,995 A * 12/1987 Davi ..... 83/167
5,575,188 A * 11/1996 Hu ..... 83/167
6,145,825 A 11/2000 Kunihiro et al.
6,199,853 B1 3/2001 Andoh et al.
6,343,785 B1 2/2002 Yamada et al.
6,381,443 B1 * 4/2002 Kawata et al. ..... 399/407
6,415,118 B1 * 7/2002 Setoriyama et al. ..... 399/92
6,494,453 B1 12/2002 Yamada et al.
6,527,269 B2 3/2003 Yamada et al.
6,549,734 B2 4/2003 Yamada et al.
6,783,124 B2 8/2004 Tamura et al.
6,905,118 B2 6/2005 Yamada et al.

(Continued)

FOREIGN PATENT DOCUMENTS

EP 1 170 099 A2 1/2002

(Continued)

OTHER PUBLICATIONS

U.S. Appl. No. 11/682,238, filed Mar. 5, 2007, Iida et al.

(Continued)

*Primary Examiner*—Kenneth E. Peterson
(74) *Attorney, Agent, or Firm*—Oblon, Spivak, McClelland, Maier & Neustadt, L.L.P.

(57) ABSTRACT

A perforator configured to perforate a sheet includes a first frame and a blade. The first frame includes a first main face having a first hole, and is provided under a transport path of the sheet. The blade is moved into the first hole to perforate the sheet transported in the transport path. A bending strength of the first main face in a vertical direction with respect to the transport path of the sheet is smaller than a bending strength of the first main face in a parallel direction with respect to the transport path of the sheet.

4 Claims, 10 Drawing Sheets

U.S. PATENT DOCUMENTS

| | | | |
|---|---|---|---|
| 6,921,069 | B2 | 7/2005 | Suzuki et al. |
| 6,957,810 | B2 | 10/2005 | Yamada et al. |
| 2003/0160376 | A1 | 8/2003 | Yamada et al. |
| 2003/0215275 | A1 | 11/2003 | Tamura et al. |
| 2003/0219295 | A1 | 11/2003 | Saitoh et al. |
| 2004/0104525 | A1 | 6/2004 | Suzuki et al. |
| 2004/0256783 | A1 | 12/2004 | Iida et al. |
| 2005/0067777 | A1 | 3/2005 | Iida et al. |
| 2005/0206071 | A1 | 9/2005 | Suzuki et al. |
| 2005/0218579 | A1 | 10/2005 | Yamada et al. |
| 2005/0225021 | A1 | 10/2005 | Yamada et al. |
| 2005/0277537 | A1 | 12/2005 | Matsushita |
| 2006/0022394 | A1 | 2/2006 | Tamura et al. |
| 2006/0055100 | A1 | 3/2006 | Suzuki et al. |

FOREIGN PATENT DOCUMENTS

| | | |
|---|---|---|
| JP | 09-272099 | 10/1997 |
| JP | 3581790 | 7/2004 |

OTHER PUBLICATIONS

U.S. Appl. No. 12/186,563, filed Aug. 6, 2008, Kikkawa et al.

* cited by examiner

HEAT-EFFECT REDUCEABLE FINISHING UNIT AND IMAGE FORMING SYSTEM USING THE SAME

CROSS-REFERENCE TO RELATED APPLICATIONS

This application claims priority from Japanese Patent Application Nos. 2005-263896, filed on Sep. 12, 2005, and 2006-163562, filed on Jun. 13, 2006, the entire contents of which are incorporated herein by reference.

FIELD OF THE INVENTION

The present disclosure generally relates to an image forming system having an image forming unit and a finishing unit, and more particularly to a finishing unit, which processes a sheet transported from an image forming unit.

DISCUSSION OF THE BACKGROUND

An image forming apparatus such as printer, copier, facsimile, and MFP (multi-functional peripherals) may be attached with a finishing unit, to which a sheet having an image thereon is ejected from the image forming apparatus.

The finishing unit may include a perforator to perforate a hole on the sheet ejected from the image forming apparatus.

The perforator includes a reciprocal type unit having a die frame, a guide frame, and a blade, for example.

The die frame includes a die hole, and is placed under a transport path of a sheet. The guide frame includes a guide hole, and is placed over the transport path of sheet.

The die hole and guide hole are aligned in a same axial direction so that the blade can be moved in a reciprocal direction through the guide hole and the die hole.

The blade is moved in the reciprocal direction through the guide hole and the die hole to perforate a hole on the sheet, transported between the die frame and guide frame.

In order to conduct such a perforation process on the sheet, the blade may be supported by the guide frame with a given allowance, such as 10 micrometers, for example.

Furthermore, the blade and die frame are designed in a manner so that the blade and die hole have a given amount of clearance between the blade and die hole, such as 10 to 20 micrometers, for example.

Such a perforator may be affected by heat generated in the image forming unit, wherein the heat may be generated when the image forming unit conducts an image transfer process, for example.

Such heat may affect a plurality of parts in the perforator, and may cause a temperature variation between the plurality of parts in the perforator.

For a reciprocal type perforator, a sheet is temporarily stopped and then pressed to the die frame to perforate a hole on the sheet with a reciprocal movement of the blade through the die hole of the die frame, wherein the sheet may receive some heat energy during the image forming process in the image forming unit.

Accordingly, the die frame may have a relatively higher temperature compared to the guide frame. In addition, the die frame and the guide frame may be firmly fixed with each other by a rivet or the like to maintain a preciseness of perforation.

Therefore, if a temperature variation occurs between the die frame and guide frame, one of the die frame and the guide frame may be deflexed.

Such deflection may be observed as an elongation of the die frame due to a temperature increase of the die frame. Such elongation may occur to the die frame because the die frame and the guide frame are fixed firmly, as discussed above.

Such deflection may occur in either one of two directions depending on a shape of the guide frame and the die frame. One direction is a parallel direction with respect to the transport direction of sheet, and another direction is a vertical direction with respect to the transport direction of sheet.

If the die frame deflects in a parallel direction with respect to the transport direction of sheet, the guide hole and die hole may be deviated from the aligned condition.

If such deviation is significant such deflection may hinder the pass-through of the blade in the die hole, and may degrade the perforation quality.

Furthermore, if the blade can not pass through the die hole smoothly, the blade may become overloaded, by which the image forming system may stop the movement of blade, and then an operation of the image forming system may be stopped.

SUMMARY OF THE INVENTION

The present disclosure relates to a perforator configured to perforate a sheet including a first frame and a blade. The first frame includes a first main face having a first hole, and is provided under a transport path of the sheet. The blade is moved into the first hole to perforate the sheet transported in the transport path. A bending strength of the first main face in a vertical direction with respect to the transport path of sheet is smaller than a bending strength of the first main face in a parallel direction with respect to the transport path of sheet.

The present disclosure also relates to another perforator configured to perforate a sheet including a first frame, a second frame, and a blade. The first frame includes a first main face having a first hole, and is provided under a transport path of the sheet. The second frame includes a second main face having a second hole aligned with the first hole in the first main face of the first frame, the second frame being provided over the transport path of the sheet. The blade is moved into the second hole and first hole to perforate the sheet transported in the transport path. A bending strength of the second main face in a vertical direction with respect to the transport path of sheet is smaller than a bending strength of the second main face in a parallel direction with respect to the transport path of sheet.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

DETAILED DESCRIPTION OF THE PREFERRED EMBODIMENTS

Figure 1:
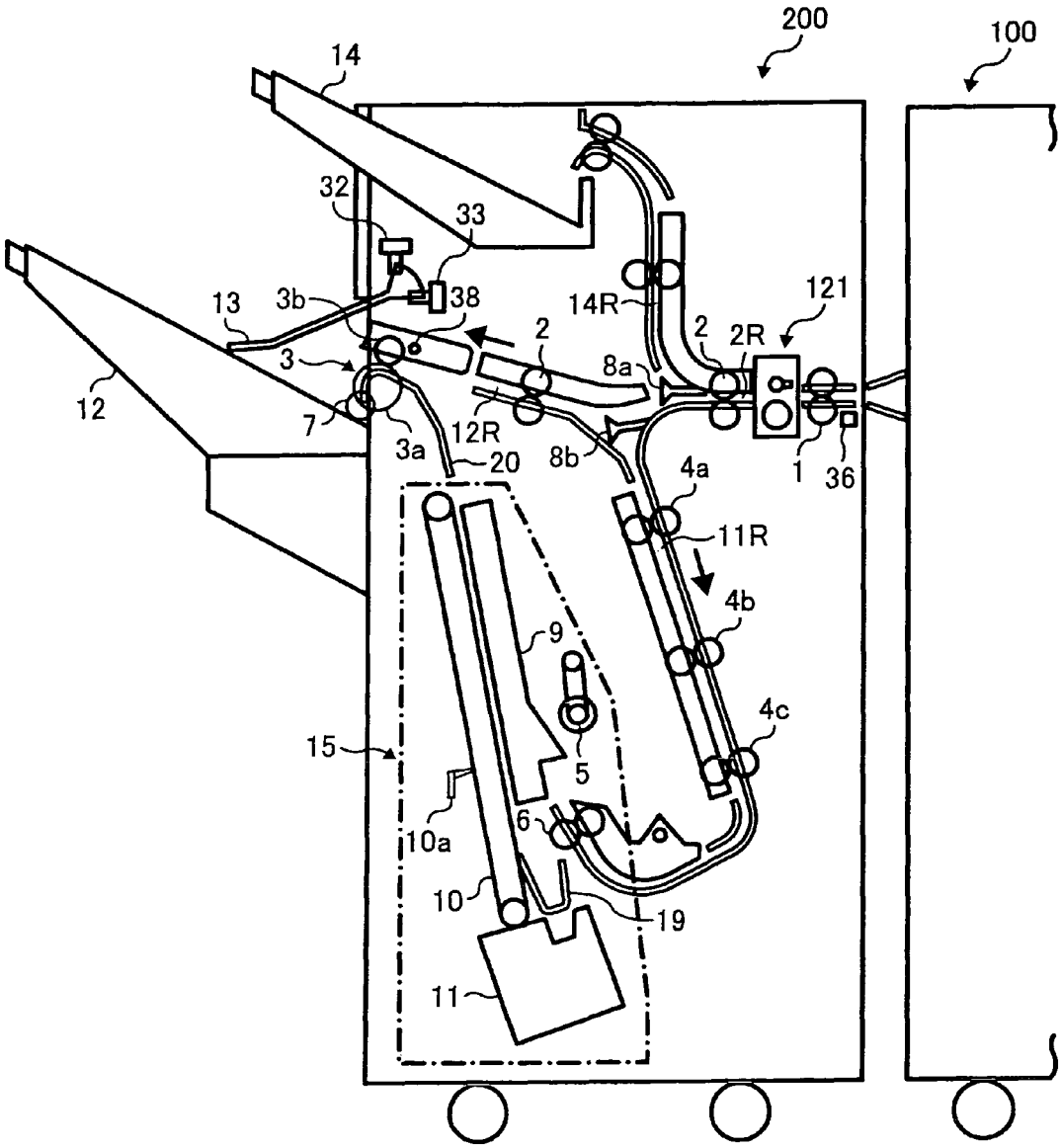
FIG. 1 is a schematic view of an image forming system having an image forming unit and a finishing unit according to an example embodiment.

In describing example embodiments shown in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming system according to an example embodiment is described with particular reference to FIGS. 1 to 6.

FIG. 1 is a schematic configuration of an image forming system including an image forming apparatus 100 and a finishing unit 200.

The image forming apparatus 100 includes a copier, for example. The finishing unit 200, attached next to the image forming apparatus 100, includes a perforator, for example.

The image forming apparatus 100 includes an image forming unit and a fixing unit, wherein the image forming unit forms a toner image on a sheet, and the fixing unit fixes the toner image on the sheet, and then the sheet is transported to the finishing unit 200 from the fixing unit.

The finishing unit 200 includes a perforator 121 to perforate a hole on the sheet transported from the image forming apparatus 100, for example.

The finishing unit 200 may conduct a plurality of processing operations to the sheet including a perforation process, and ejects the sheet outside of the finishing unit 200 after conducting processing operations to the sheet.

As shown in FIG. 1, the image forming apparatus 100 transports a sheet to the finishing unit 200 via a sheet transport route 2R.

As shown in FIG. 1, the sheet transport route 2R is surrounded by an entrance sensor 36, the perforator 121 (e.g., reciprocal type unit), an entrance roller 1, and separation claws 8*a* and 8*b*, for example.

The entrance sensor 36 detects a front edge and a rear edge of a sheet transported from the image forming apparatus 100.

Each of the separation claws 8*a* and 8*b* is controlled by a solenoid (not shown) and a spring (not shown).

By adjusting a position of the separation claws 8*a* and 8*b*, the sheet transported from the image forming apparatus 100 can be transported to a first sheet tray 12, a second sheet tray 14, or to a stapler 11, as required.

As shown in FIG. 1, a sort/stack route 12R extends from the sheet transport route 2R to the first sheet tray 12.

The sort/stack route 12R includes a transport roller 2, a sheet ejection sensor 38, an ejection roller 3, an adjust roller 7, a sheet detection lever 13, and sheet detection sensors 32 and 33, for example.

The sheet ejection sensor 38 detects a sheet. The ejection roller 3 includes a drive roller 3*a* and a driven roller 3*b*. The adjust roller 7 adjusts a lateral edge of sheets to one side on the first sheet tray 12.

The sheet detection lever 13 moves in a vertical direction depending on a number of sheets stacked on the first sheet tray 12.

The sheet detection sensors 32 and 33 detect a height of sheets stacked on the first sheet tray 12.

As for the ejection roller 3, the driven roller 3*b* is normally biased and contacted to the drive roller 3*a* with a self-weight of the driven roller 3*b* or spring force, for example.

Sheets or stapled sheets can be ejected to the first sheet tray 12 through a nip between the drive roller 3*a* and driven roller 3*b*.

As shown in FIG. 1, a transport route 14R extends from the sheet transport route 2R to the second sheet tray 14, and a plurality of transport rollers are disposed along the transport route 14R.

The second sheet tray 14 stacks sheets printed by facsimile or printer function of the image forming apparatus 100, wherein such facsimile or printer function may be conducted by interrupting another function, such as copying.

As shown in FIG. 1, a staple transport route 11R extends from the sheet transport route 2R to the stapler 11 in a staple unit 15, and a plurality of transport rollers 4*a*, 4*b*, and 4*c* are disposed along the staple transport route 11R.

The staple unit 15 includes a sheet ejection sensor (not shown), and a sheet feed roller 6 having a brush, for example.

The transport rollers 4*a*, 4*b*, and 4*c* can be driven by a transport motor (not shown).

The staple unit 15 includes a staple tray (not shown) and the stapler 11, wherein the staple tray is used to support parts used for staple unit 15, and the stapler 11 is provided under the staple tray.

The staple tray is attached with a jogger fence 9, a return roller 5, and an ejection belt 10.

The jogger fence 9 collates sheets. The ejection belt 10 is provided next to the jogger fence 9 to eject stapled sheets.

The ejection belt 10 includes an ejection claw 10*a* fixed on the ejection belt 10, wherein the ejection claw 10*a* can support a rear edge of stapled sheets stapled by the stapler 11.

The jogger fence 9 can be moved in a width direction of the sheet by a jogger motor (not shown) and jogger belt (not shown).

The return roller 5 can be driven with a solenoid (not shown), and can contact a surface of sheet.

As shown in FIG. 1, a rear fence 19 is disposed under the jogger fence 9, wherein the rear fence 19 can be abutted to a rear edge of sheets.

The stapler 11 can be driven by a stapler motor (not shown) and a stapler belt (not shown), and can be moved in a front and rear direction of the finishing unit 200.

The rear edge of the stapled sheets, stapled by the stapler 11, is supported by the ejection claw 10*a* fixed on the ejection belt 10.

Then, with movement of the ejection belt 10 driven by an ejection motor (not shown), the stapled sheets are guided by the guide plate 20 and are ejected to the first sheet tray 12.

The first sheet tray 12 can be hung by a lift belt (not shown), for example, wherein the lift belt can be driven by a lift motor (not shown) and a gear system having a worm gear and a timing belt.

The lift belt can be moved in a vertical direction (i.e., upward or downward direction) by adjusting a rotation direction of the lift motor.

The first sheet tray 12 can be moved in a horizontal direction with a shift motor (not shown), as required.

The sheet detection lever 13 and sheet detection sensors 32 and 33 are used to detect a home position and height of the first sheet tray 12.

When the first sheet tray 12, moveable in vertical and horizontal direction, is filled with sheets, such as stapled sheets, a limit sensor (not shown) detects such condition.

If the adjust roller 7 is pushed by the first sheet tray 12 when the first sheet tray 12 moves in a upward direction, a limit switch (not shown) is switched to an OFF state to stop a rotation of the lift motor, by which mechanical damage caused by overrunning of the first sheet tray 12 can be prevented.

Hereinafter, the perforator 121 and its surrounding are explained with reference to FIGS. 2 and 3.

Figure 2:
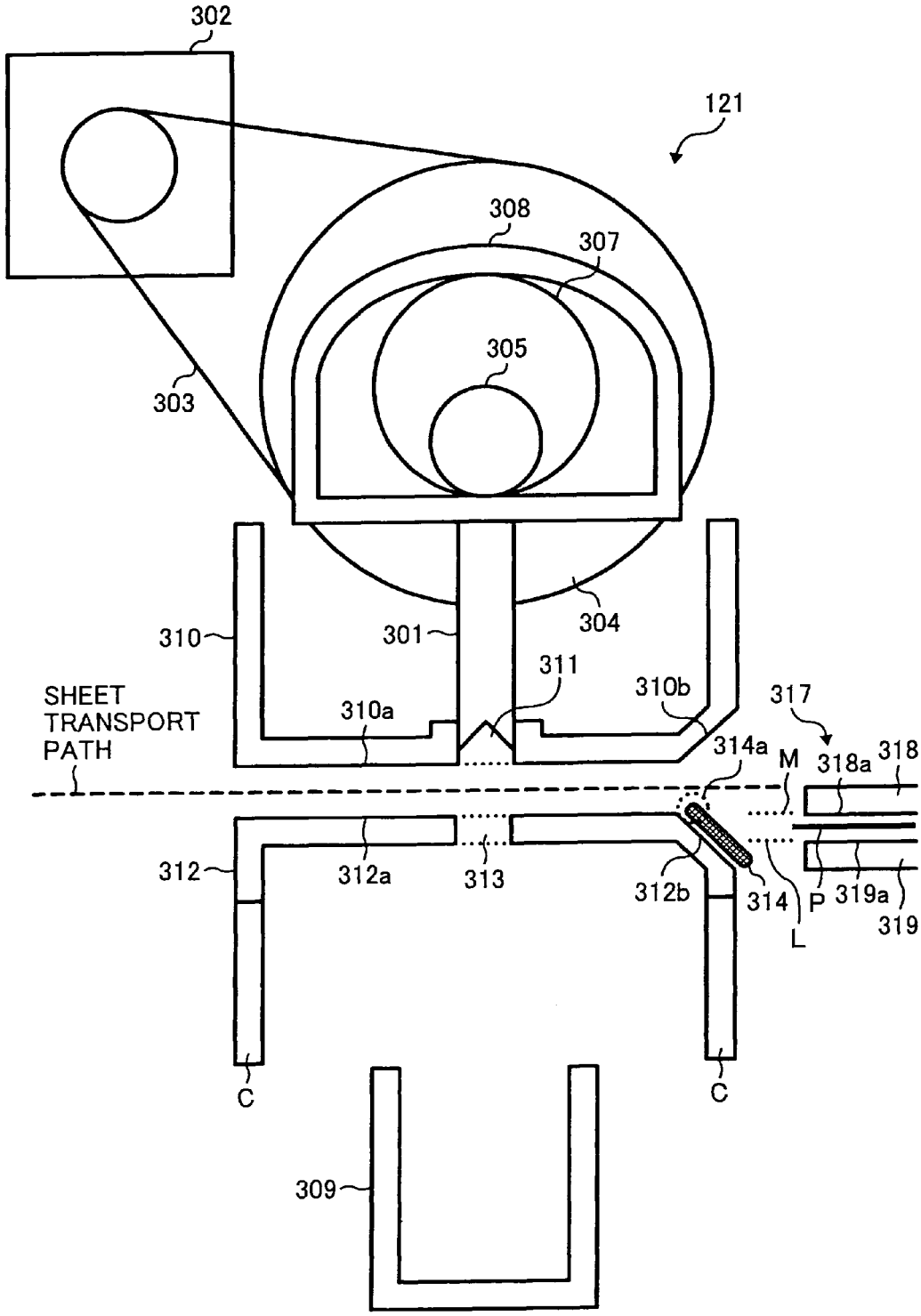
FIG. 2 is a schematic cross sectional view of a perforator according to an example embodiment.

FIG. 2 is a schematic cross sectional view of the perforator 121 according to an example embodiment.

Figure 3:
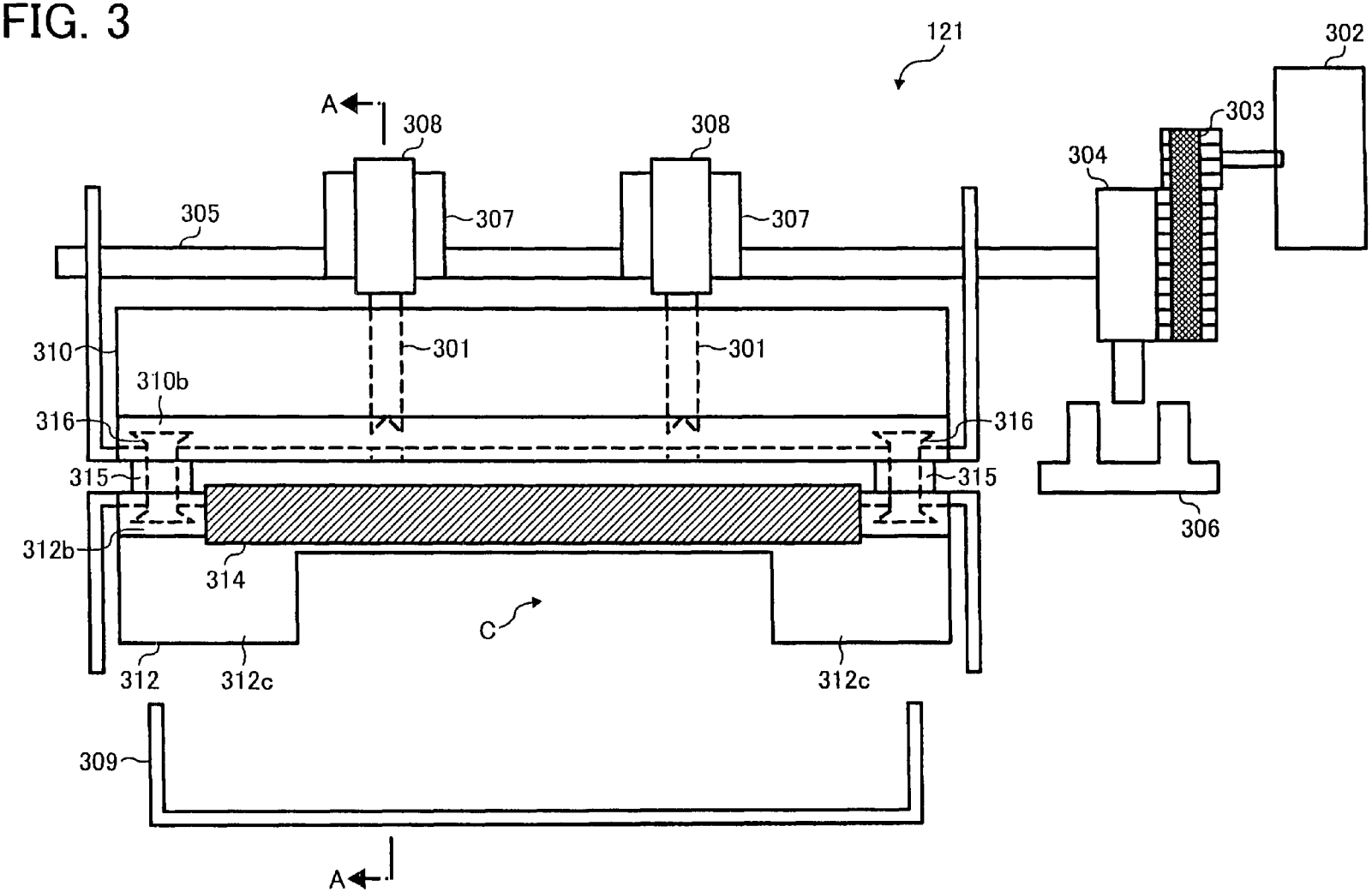
FIG. 3 is a schematic view of a perforator according to an example embodiment when viewed from a sheet entrance side.

FIG. 3 is a schematic view of the perforator 121 when viewed from a sheet entrance side. FIG. 2 corresponds to a cross-section view cut at line A-A in FIG. 3.

As shown in FIGS. 2 and 3, the perforator 121 may include a blade 301, a guide frame 310, and a die frame 312. The perforator 121 may also include a motor 302, a belt 303, a drive pulley 304, a shaft 305, a home position sensor 306, a cam 307, a holder 308, a hopper 309, a heat insulating member 314, a spacer 315, a rivet 316, and a transport guide member 317, for example.

The blade 301 can perforate a hole on a sheet P when the blade 301 moves in a vertical direction with respect to a transport direction of sheet P.

As shown in FIG. 2, the blade 301 has an edge formed in wedge shape so that the blade 301 can easily perforate a hole on the sheet P.

The motor 302 can drive the drive pulley 304 via the belt 303. The motor 302 can transmit a driving force to the drive pulley 304 because the belt 303 connects the motor 302 and drive pulley 304.

The drive pulley 304 can drive the blade 301 in a vertical direction with respect to a transport direction of sheet P via the shaft 305, cam 307, and holder 308.

The home position sensor 306 detects an initial position of blade 301 in the perforator 121.

The holder 308 can regulate a position of the blade 301. The blade 301 can be moved in an upward and downward direction when the cam 307 makes a given rotational movement around the shaft 305 with a movement of the drive pulley 304.

The hopper 309 recovers cuttings of the sheet P, which are produced when the blade 301 perforates a hole on the sheet P.

As shown in FIGS. 2 and 3, the die frame 312 may be provided under the transport path of sheet P, and guides the sheet P from the downward direction.

The die frame 312 includes a first main face 312*a* and a first inclined corner 312*b*, for example. The first inclined corner 312*b* is extended along the first main face 312*a* (see FIG. 6A).

The die frame 312 also includes a die hole 313 on the first main face 312*a*, through which the blade 301 moves in the vertical direction with respect to the transport direction of the sheet P.

The first main face 312*a* can be used to guide the sheet P from the downward direction, and the first inclined corner 312*b* is inclined with respect to the transport direction of sheet P as shown in FIG. 2.

As shown in FIGS. 2 and 3, the guide frame 310 may be provided over an upper area of the transport path of sheet P, and guides the sheet P from the upward direction.

The guide frame 310 includes a second main face 310*a* and a second inclined corner 310*b*, for example. The second inclined corner 310*b* is extended along the second main face 310*a* (see FIG. 6A).

The guide frame 310 also includes a guide hole 311 on the second main face 310*a*, through which the blade 301 moves in the vertical direction with respect to the transport direction of the sheet P.

The second main face 310*a* can be used to guide the sheet P from the upward direction, and the second inclined corner 310*b* is inclined with respect to the transport direction of the sheet P as shown in FIG. 2.

By forming the first inclined corner 312*b* and the second inclined corner 310*b* as shown in FIG. 2, the sheet P can be easily guided between the first main face 312*a* and second main face 310*a*.

The die frame 312 may include a cut-off area C except the first main face 312*a* and first inclined corner 312*b*, which face the transport direction of sheet P as shown in FIGS. 2 and 3. Such cut-off area C will be explained later with FIG. 6.

The cut-off area C may be cut in a rectangular shape from a face, which has no specific function in the die frame 312, as shown in FIG. 6.

However, such cut-off area C can be cut in any shape depending on an entire shape of the die frame 312, and considering other parts around the die frame 312.

The heat insulating member 314 can be made of material having lower heat conductivity compared to a material for the die frame 312.

As shown in FIGS. 2 and 3, the heat insulating member 314 may be disposed along the first inclined corner 312*b*.

The sheet P may absorb some heat energy when a fixing process is conducted in the image forming apparatus 100. Such heated sheet P is transported to the perforator 121 through the first inclined corner 312*b*, and then the sheet P passes through a transport path in the perforator 121.

The heat insulating member 314 may contact the sheet P when the sheet P passes through the first inclined corner 312*b*, by which the heat insulating member 314 may suppress heat conduction from the heated sheet P to the first inclined corner 312*b*.

Accordingly, the heat insulating member 314 may suppress heat conduction from the heated sheet P to the die frame 312.

As shown in FIG. 2, the heat insulating member 314 includes an edge portion 314*a*, which protrudes from the first main face 312*a* with some length.

The die frame 312 and guide frame 310 have a given space between the first main face 312*a* and second main face 310*a*. For example, such space may be approximately 2 mm.

Therefore, if the edge portion 314*a* may protrude from the first main face 312*a* within a range of 0.5 mm to 1 mm, for example, such edge portion 314*a* may not hinder a transportation of the sheet P.

The heat insulating member 314 is preferably made of elastic material such as polyester film to reduce hindering of transportation of sheet P by the heat insulating member 314.

As shown in FIG. 3, the spacer 315 is disposed at each lateral side of the transport path in the perforator 121. The spacer 315 is used to effectively secure the given space between the guide frame 310 and die frame 312.

The rivet 316 is used to firmly fix the guide frame 310 and die frame 312 each other to maintain a positional relationship of the guide frame 310 and die frame 312.

With such configuration for the guide frame 310 and die frame 312, the perforator 121 may conduct sheet perforation precisely.

As shown in FIG. 2, the transport guide member 317 is provided in an upstream of transport direction of sheet P with respect to the guide frame 310 and die frame 312, and guides the sheet P to the given space between the guide frame 310 and die frame 312.

The transport guide member 317 includes an upper guide member 318 and a lower guide member 319, wherein the upper guide member 318 guides the sheet P from the upward direction and the lower guide member 319 guides the sheet P from the downward direction.

The upper guide member 318 includes an upper guide face 318*a*, which guides the sheet P from the upward direction.

The lower guide member 319 includes a lower guide face 319*a*, which guides the sheet P from the downward direction.

As shown in a configuration in FIG. 2, the upper guide face 318*a* of the upper guide member 318 may be positioned below the second main face 310*a* of the guide frame 310 (refer to the dotted line M in FIG. 2), and the lower guide face 319*a* of the lower guide member 319 may be positioned below the first main face 312*a* of the die frame 312 (refer to the dotted line L in FIG. 2).

With such arrangement, the sheet P may be more likely to contact with the die frame 312 compared to the guide frame 310 in a configuration shown in FIG. 2.

Accordingly, the die frame 312 may be more affected by the heated sheet P compared to the guide frame 310.

Therefore, design work for coping with temperature change in the perforator 121 may be mainly considered for the die frame 312, but not for the guide frame 310, by which the design work can be conducted with fewer amount of time or steps. Accordingly, the total amount of design work can be reduced.

Figure 4:
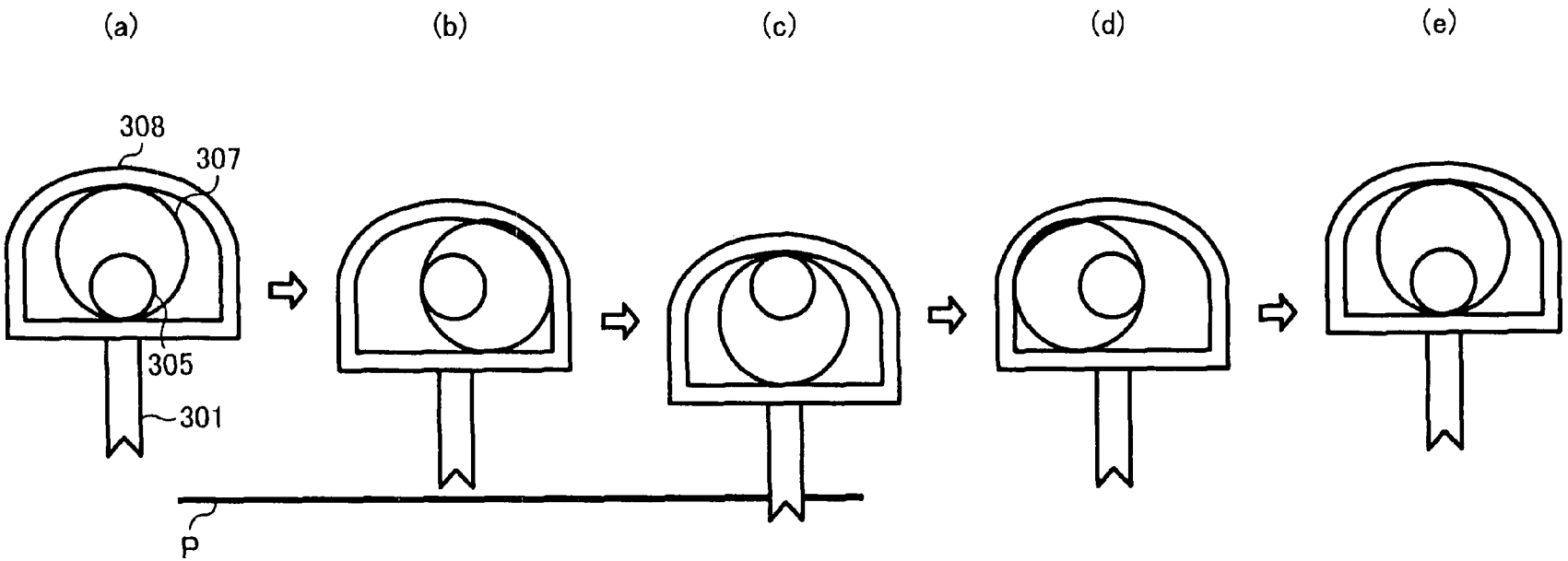
FIG. 4 is a schematic sequence view explaining a perforation process of sheet by a perforator.

FIG. 4 shows schematic sequential views for explaining a process of perforation on the sheet P by the perforator 121. With reference to FIG. 4, a process of perforation on the sheet P by the perforator 121 is explained.

In a configuration shown in FIG. 2, the upper guide face 318*a* of the upper guide member 318 may be positioned below the second main face 310*a* of the guide frame 310 (refer to a dotted line M in FIG. 2), and the lower guide face 319*a* of the lower guide member 319 may be positioned below the first main face 312*a* of the die frame 312 (refer to a dotted line L in FIG. 2).

With such arrangement, the sheet P may be transported from the transport guide member 317 to the first inclined corner 312*b* of the die frame 312.

The heat insulating member 314 overlays the first inclined corner 312*b* as above-mentioned, therefore, the sheet P may contact with the heat insulating member 314.

Accordingly, the sheet P may not contact the first inclined corner 312*b* directly, by which the heat insulating member 314 may suppress heat conduction from the sheet P to the first inclined corner 312*b*.

Therefore, a temperature increase of the die frame 312 is suppressed.

Furthermore, the edge portion 314*a* may effectively prevent a contact of the sheet P to the die frame 312 as below explained.

In general, the sheet P in a transport path may not be strictly parallel to the transport path, but the sheet P in the transport path may be somehow curled in a downward direction, for example.

If the edge portion 314*a* is not provided, the curled portion of sheet P may contact the first main face 312*a* when the sheet P enters the perforator 121, by which the sheet P may transmit heat to the die frame 312.

However, by providing the edge portion 314*a*, the curled portion of the sheet P may not contact the first main face 312*a* at an entrance of the die frame 312, by which a temperature increase of the die frame 312 may be suppressed.

The sheet P transported from the image forming apparatus 100 with such manner is stopped temporarily in the perforator 121 to receive a perforation operation.

The sheet P is perforated by moving the blade 301 in an upward/downward direction with the motor 302, and passing the blade 301 through the guide hole 311 and die hole 313.

The motor 302 drives the drive pulley 304 and shaft 305 via the belt 303.

The home position sensor 306 detects a rotation of the drive pulley 304 and shaft 305.

A control unit transmits a signal to the motor 302 to stop the rotation of the drive pulley 304 and shaft 305 after rotating the shaft 305 for one rotation.

When the shaft 305 rotates, the cam 307 rotates with a rotation of the shaft 305 and moves the holder 308 in an upward/downward direction, wherein the shaft 305 is eccentrically engaged to the cam 307 as shown in FIGS. 2 and 3.

FIG. 4(*a*) shows an initial position of the holder 308 in the perforator 121, in which the shaft 305 contacts the holder 308.

In FIG. 4(*b*), the cam 307 rotates in a clockwise direction with a rotation of the shaft 305 to move the blade 301 in a downward direction.

In FIG. 4(*c*), the cam 307 further rotates, and the shaft 305 contacts the holder 308 at an upper portion of the holder 308. At this position, the blade 301 is moved to the lowest position to perforate the sheet P.

In FIG. 4(*d*), the cam 307 further rotates in a clockwise direction and moves the blade 301 in an upward direction.

In FIG. 4(*e*), the shaft 305 and cam 307 return to the initial position shown in FIG. 4(*a*) and one cycle of perforation operation has been completed, and the motor 302 is stopped temporarily until a next perforation operation.

As such, when the holder 308 moves in an upward/downward direction, the blade 301 moves in an upward/downward direction, and then the blade 301 passes through the guide hole 311 of the guide frame 310 and the die hole 313 of the die frame 312.

After perforating holes on the sheet P, the finishing unit 200 may conduct another processing operation to the sheet P, as required.

During such perforation operation, the hopper 309 recovers cuttings of perforated sheet cut from the sheet P.

The die frame 312 can include a cut-off area C on a first side face perpendicular to the first main face 312*a*, which will be explained later with respect to FIGS. 6A and 6B.

Figure 6A:
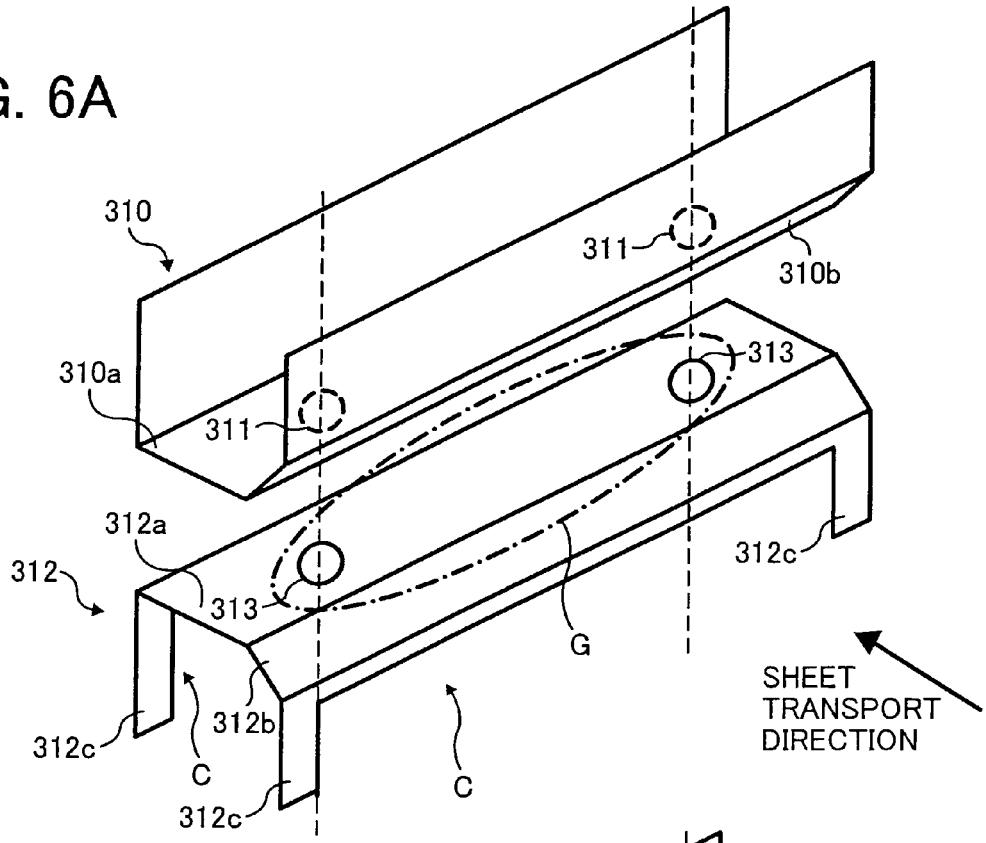
FIGS. 6A and 6B are perspective views of a guide frame and a die frame, in which a die frame has a cut-off area.
Figure 6B:
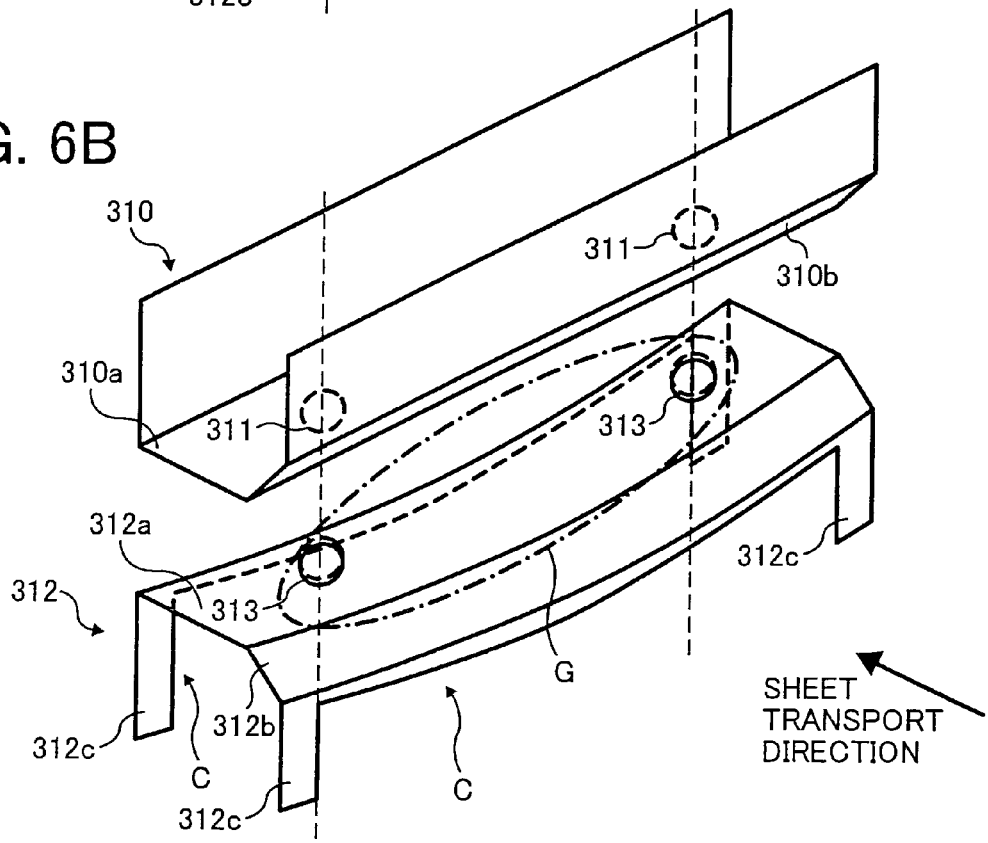

If the cut-off area C is set to the die frame 312 as shown in FIGS. 6A and 6B, the die frame 312 may have a smaller face area in the first side face perpendicular to the first main face 312*a* of the die frame 312.

In such a case, a bending strength of the first main face 312*a* in a vertical direction with respect to the transport path of sheet P may become smaller than a bending strength of the first main face 312*a* in a parallel direction with respect to the transport path of sheet P.

Hereinafter, such bending strength is explained with reference to FIGS. 5 and 6.

Figure 5A:
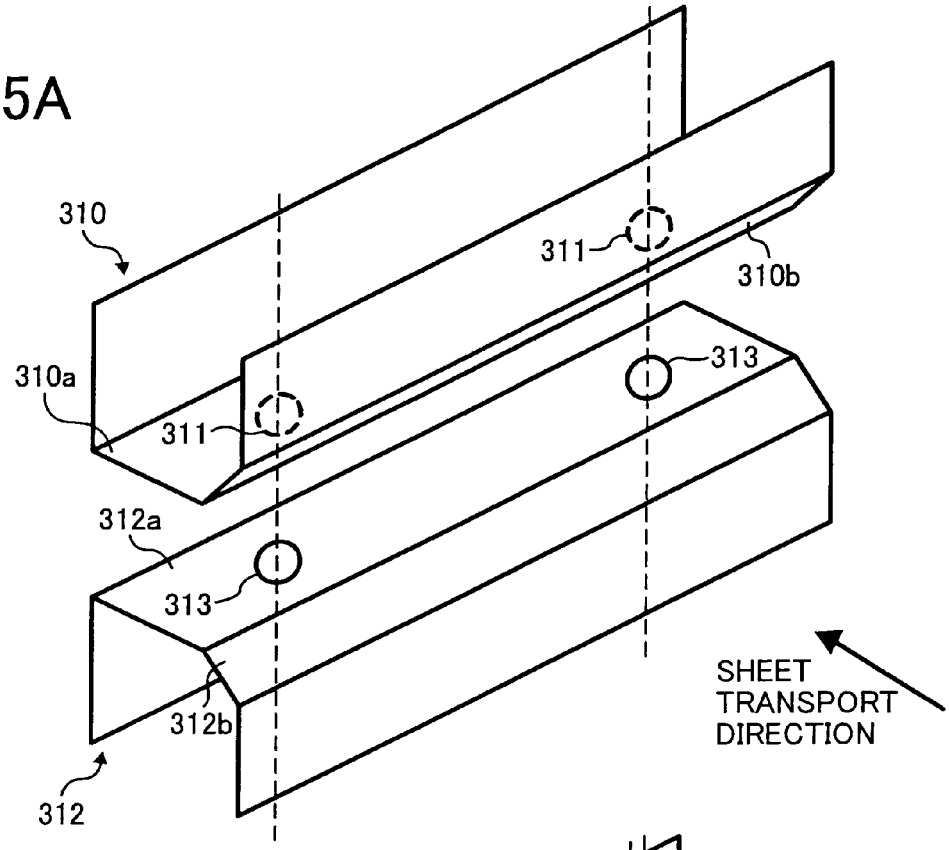
FIGS. 5A and 5B are perspective views of a guide frame and a die frame, in which a die frame has no cut-off area.
Figure 5B:
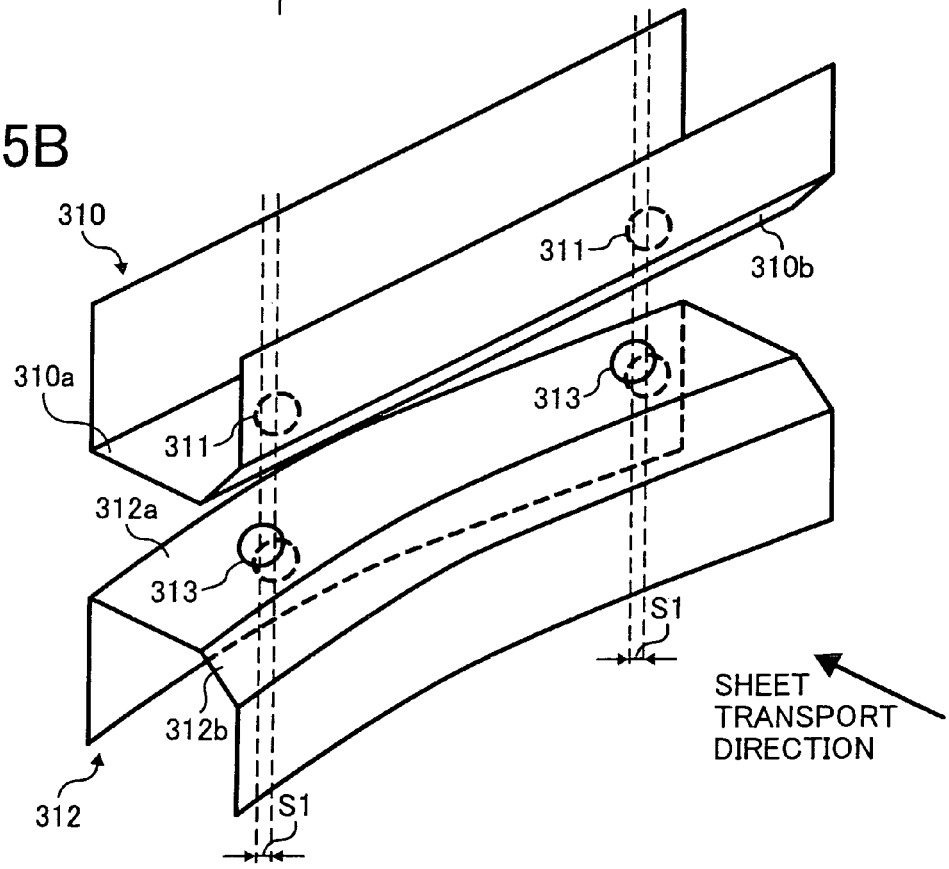

FIGS. 5A and 5B are perspective views of the guide frame 310 and die frame 312, in which the die frame 312 has no cut-off area.

FIGS. 6A and 6B are perspective views of the guide frame 310 and die frame 312, in which the die frame 312 has a cut-off area C.

In FIG. 5A, the sheet P has not yet transmitted heat to the die frame 312. In such a case, the die frame 312 is in a lower temperature condition, and thereby the die frame 312 may not deflect.

Accordingly, the guide hole 311 and die hole 313 are aligned on a same axis direction, by which the blade 301 can pass through the guide hole 311 and die hole 313 smoothly.

However, if the sheet P is transported in the perforator 121 and only the die frame 312 may have a higher temperature, the die frame 312 may deflect significantly compared to the guide frame 310.

A deflection caused by such a heated sheet P may be observed as warping of a plane having a smaller bending strength in the die frame 312.

In case of the die frame 312 having no cut-off area (refer to FIG. 5A), a bending strength of the first main face 312*a* in a parallel direction with respect to the transport path of sheet P may become smaller than a bending strength of the first main face 312*a* in a vertical direction with respect to the transport path of sheet P.

Therefore, as shown in FIG. 5B, the die frame 312 having no cut-off area may warp in a parallel direction with respect to the transport path of sheet P.

With such warping, the die hole 313 may deviate from an original position, and the guide hole 311 and die hole 313 may not align on the same axis direction, which is indicated by a positional deviation S1 in FIG. 5B.

In a condition shown in FIG. 5B, the blade 301 may not pass through the guide hole 311 and die hole 313 smoothly or the blade 301 cannot pass through the guide hole 311 and die hole 313.

In view of such drawback, a configuration having a cut-off area C shown in FIG. 6 is employed for the die frame 312.

FIG. 6A shows the die frame 312 in lower temperature condition.

The die frame 312 can include the cut-off area C on a first side face 312*c* perpendicular to the first main face 312*a* as shown in FIG. 6A.

If the cut-off area C is set to the die frame 312 as shown in FIGS. 6A and 6B, the die frame 312 may have a smaller face area in the first side face 312*c,* which is perpendicular to the first main face 312*a*.

By providing the cut-off area C in the die frame 312 as shown in FIGS. 6A and 6B, a bending strength of the first main face 312*a* in a vertical direction with respect to the transport path of sheet P may become smaller than a bending strength of the first main face 312*a* in a parallel direction with respect to the transport path of sheet P.

Therefore, as shown in FIG. 6B, the die frame 312 may warp in a vertical direction with respect to the transport path of sheet P.

If the first main face 312*a,* indicated by an area G, may warp in a vertical direction with respect to the transport path of sheet P, the die hole 313 may not substantially deviate from the original position, and the guide hole 311 and die hole 313 may still align on the same axis direction substantially as shown in FIG. 6B.

In a condition shown in FIG. 6B, the blade 301 may pass through the guide hole 311 and die hole 313 smoothly.

As such, a condition shown in FIG. 6B may reduce a temperature effect to the die frame 312, and may suppress the deflection of the first main face 312*a* in a parallel direction with respect to the transport path of sheet P, which may affect the alignment of the guide hole 311 and die hole 313. Accordingly, an alignment deviation of the guide hole 311 and die hole 313 may be suppressed.

Furthermore, the heat insulating member 314 may be overlaid on the die frame 312 as above-mentioned, by which the sheet P may contact the heat insulating member 314 before the sheet P enters a sheet transport path in the perforator 121.

Accordingly, a contact time of the sheet P and die frame 312 may be reduced when the sheet P enters and passes through the perforator 121, by which a temperature increase of die frame 312 may be suppressed.

Therefore, the heat insulating member 314 may suppress a temperature change of the die frame 312, by which the deflection of the first main face 312*a* in a vertical direction with respect to the transport path of sheet P may be suppressed.

Accordingly, the alignment deviation of the guide hole 311 and die hole 313 may be suppressed.

Although the cut-off area C and the heat insulating member 314 are provided for the die frame 312 in the above explained example embodiment, the cut-off area C and heat insulating member 314 may be provided for the guide frame 310, as explained below with reference to FIGS. 7 and 8.

Figure 7:
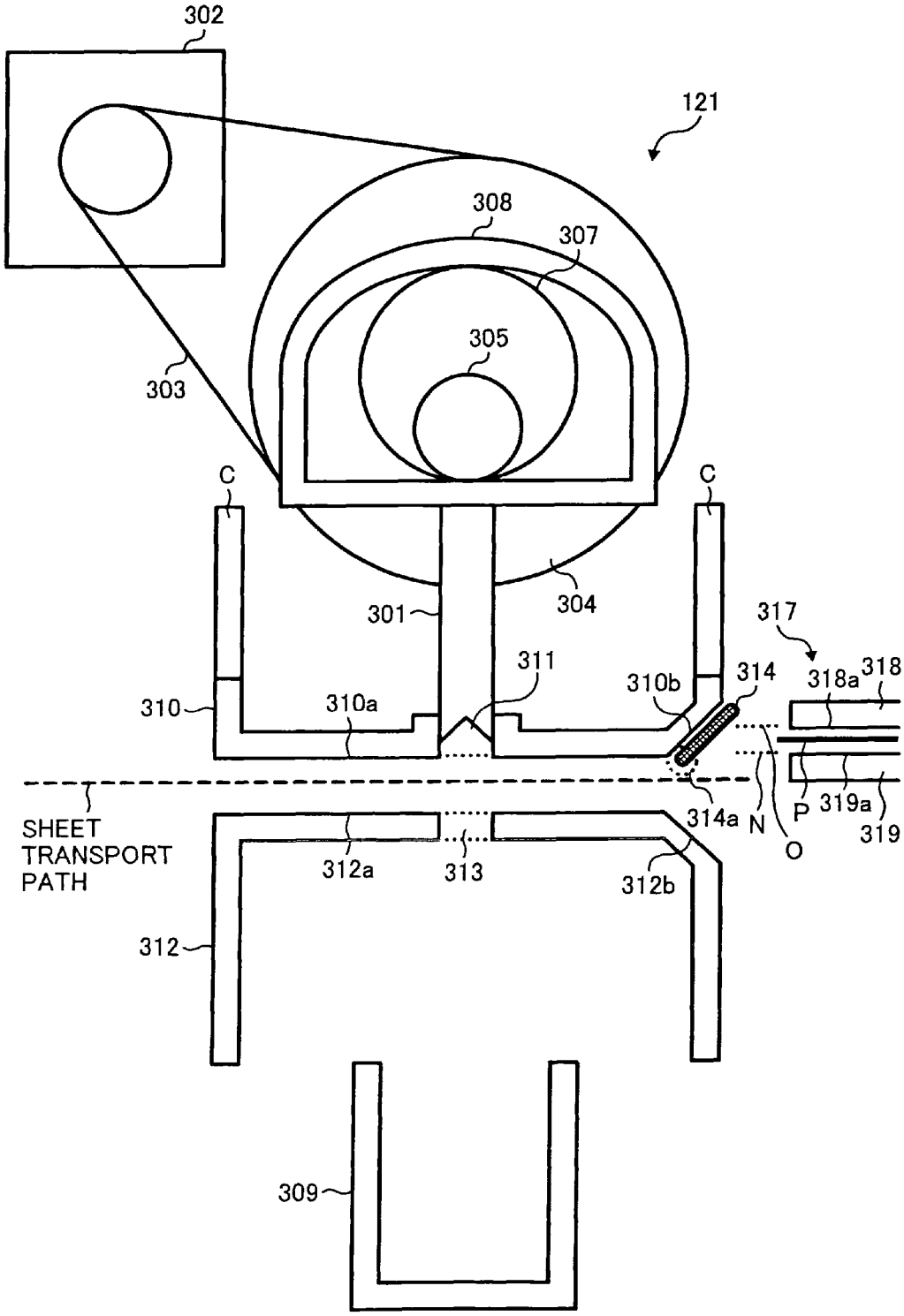
FIG. 7 is a schematic cross sectional view of a perforator according to another example embodiment.

FIG. 7 is a schematic cross sectional view of the perforator 121 according to another example embodiment.

Figure 8:
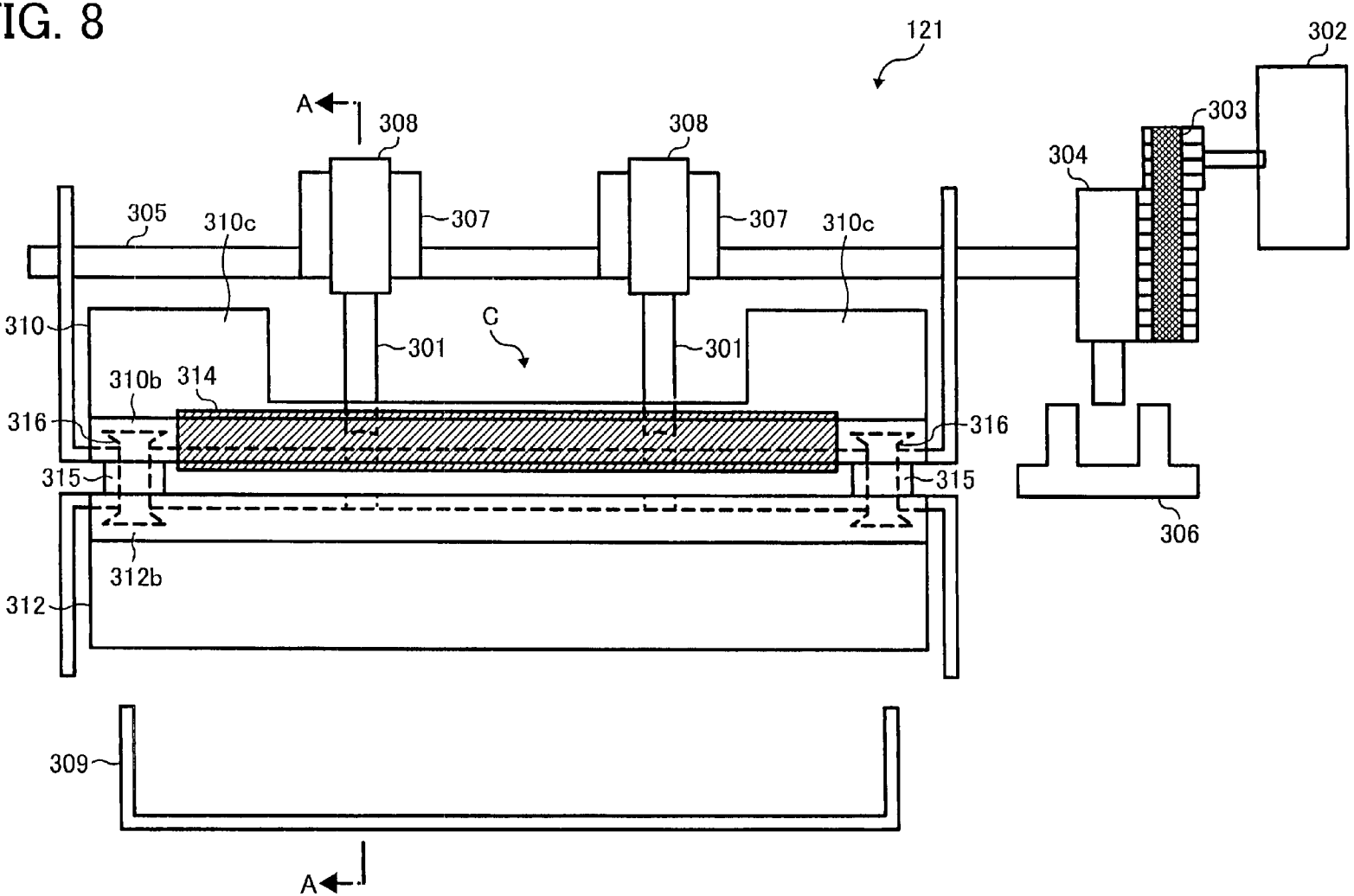
FIG. 8 is a schematic cross sectional view of a perforator according to another example embodiment when viewed from a sheet entrance side.

FIG. 8 is a schematic view of the perforator 121 according to another example embodiment when viewed from a sheet entrance side. FIG. 7 corresponds to a cross-section view cut at line A-A in FIG. 8.

The perforator 121 shown in FIGS. 7 and 8 may employ similar components shown in FIGS. 2 and 3, but some of them may have different arrangement or shape as below explained.

The guide frame 310 may include a cut-off area C except the second main face 310*a* and second inclined corner 310*b,* which face the transport direction of sheet P, as shown in FIGS. 7 and 8. Such cut-off area C will be explained later with respect to FIG. 10.

The cut-off area C may be cut in a rectangular shape from a facethat has no specific function in the guide frame 310, as shown in FIG. 10.

However, such cut-off area C can be cut in any shape depending on an entire shape of the guide frame 310, and considering other parts around the guide frame 310.

On one hand, the die frame 312 has no cut-off area C in another example embodiment shown in FIGS. 7 and 8.

The heat insulating member 314 can be made of material having lower heat conductivity compared to a material for the guide frame 310.

As shown in FIGS. 7 and 8, the heat insulating member 314 may be disposed along the second inclined corner 310*b,* which is different from a configuration in FIGS. 2 and 3.

The sheet P may absorb some heat energy when a fixing process is conducted in the image forming apparatus 100. Such heated sheet P is transported to the perforator 121 through the second inclined corner 310*b,* and then the sheet P passes through a transport path in the perforator 121.

The heat insulating member 314 may contact the sheet P when the sheet P passes through the second inclined corner 310*b,* by which the heat insulating member 314 may suppress heat conduction from the heated sheet P to the second inclined corner 310*b*.

Accordingly, the heat insulating member 314 may suppress heat conduction from the heated sheet P to the guide frame 310.

As shown in FIG. 7, the heat insulating member 314 includes the edge portion 314*a,* which protrudes from the second main face 310*a* with some length.

The die frame 312 and guide frame 310 have the given space between the first main face 312*a* and second main face 310*a*. For example, such space may be approximately 2 mm.

Therefore, if the edge portion 314*a* protrudes from the second main face 310*a* within a range of 0.5 mm to 1 mm, for example, such edge portion 314*a* may not hinder transportation of the sheet P.

The heat insulating member 314 is preferably made of elastic material, such as polyester film, to reduce hindering of transportation of sheet P by the heat insulating member 314.

As shown in FIG. 7, the transport guide member 317 is provided upstream of the transport direction of sheet P with respect to the guide frame 310 and die frame 312, and guides the sheet P to the given space between the guide frame 310 and die frame 312.

The transport guide member 317 includes the upper guide member 318 and the lower guide member 319, wherein the upper guide member 318 guides the sheet P from the upward direction and the lower guide member 319 guides the sheet P from the downward direction.

The upper guide member 318 includes the upper guide face 318*a*, which guides the sheet P from the upward direction.

The lower guide member 319 includes the lower guide face 319*a*, which guides the sheet P from the downward direction.

In a configuration shown in FIG. 7, the upper guide face 318*a* of the upper guide member 318 may be positioned above the second main face 310*a* of the guide frame 310 (refer to the dotted line O in FIG. 7), and the lower guide face 319*a* of the lower guide member 319 may be positioned above the first main face 312*a* of the die frame 312 (refer to the dotted line N in FIG. 7).

With such arrangement, the sheet P may be more likely to contact with the guide frame 310 compared to the die frame 312.

Accordingly, the guide frame 310 may be more affected by the heated sheet P compared to the die frame 312.

Therefore, design work for coping with the temperature change in the perforator 121 may be mainly considered for the guide frame 310, but not for the die frame 312, by which the design work can be conducted with fewer time or steps. Accordingly, the total amount of design work can be reduced.

The perforator 121 shown in FIG. 7 can perforate a hole on the sheet P in a similar manner explained with respect to FIG. 4. However, the sheet P is transported in a different manner in the perforator 121, as explained below.

In a configuration shown in FIG. 7, the upper guide face 318*a* of the upper guide member 318 may be positioned above the second main face 310*a* of the guide frame 310 (refer to the dotted line O in FIG. 7), and the lower guide face 319*a* of the lower guide member 319 may be positioned above the first main face 312*a* of the die frame 312 (refer to the dotted line N in FIG. 7).

With such arrangement, the sheet P may be transported from the transport guide member 317 to the second inclined corner 310*b* of the guide frame 310.

The heat insulating member 314 overlays the second inclined corner 310*b* as above-mentioned, therefore, the sheet P may contact with the heat insulating member 314.

Accordingly, the sheet P may not contact the second inclined corner 310*b* directly, by which the heat insulating member 314 may suppress heat conduction from the sheet P to the second inclined corner 310*b*.

Therefore, a temperature increase of the guide frame 310 may be suppressed.

Furthermore, the edge portion 314*a* may effectively prevent a contact of the sheet P to the guide frame 310, as explained below.

In general, the sheet P in a transport path may not be strictly parallel to the transport path, but the sheet P in the transport path may be somehow curled in an upward direction, for example.

If the edge portion 314*a* is not provided, the curled portion of sheet P may contact the second main face 310*a* when the sheet P enters the perforator 121, by which the sheet P may transmit heat to the guide frame 310.

However, by providing the edge portion 314*a*, the curled portion of the sheet P may not contact the second main face 310*a* at an entrance of the guide frame 310, by which a temperature increase of the guide frame 310 may be suppressed.

The sheet P transported from the image forming apparatus 100 with such manner is stopped temporarily in the perforator 121 to receive a perforation operation.

The guide frame 310 can include a cut-off area C on a second side face perpendicular to the second main face 310*a*, which will be explained later with respect to FIGS. 10A and 10B.

Figure 10A:
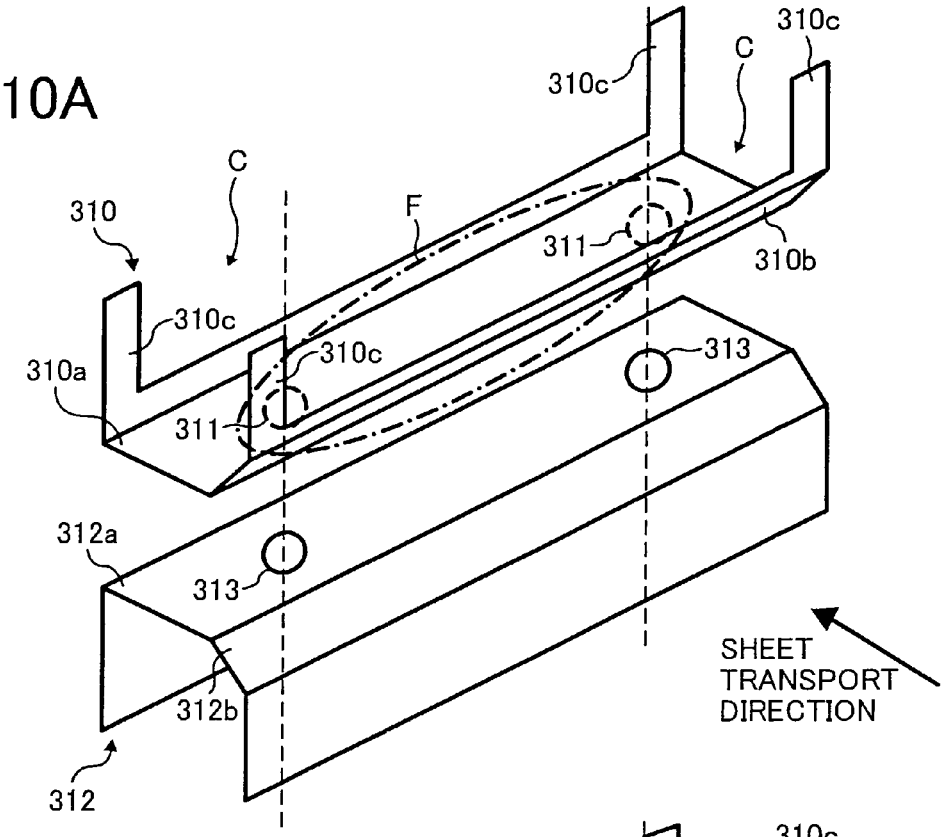
FIGS. 10A and 10B are perspective views of a guide frame and a die frame, in which a guide frame has a cut-off area.
Figure 10B:
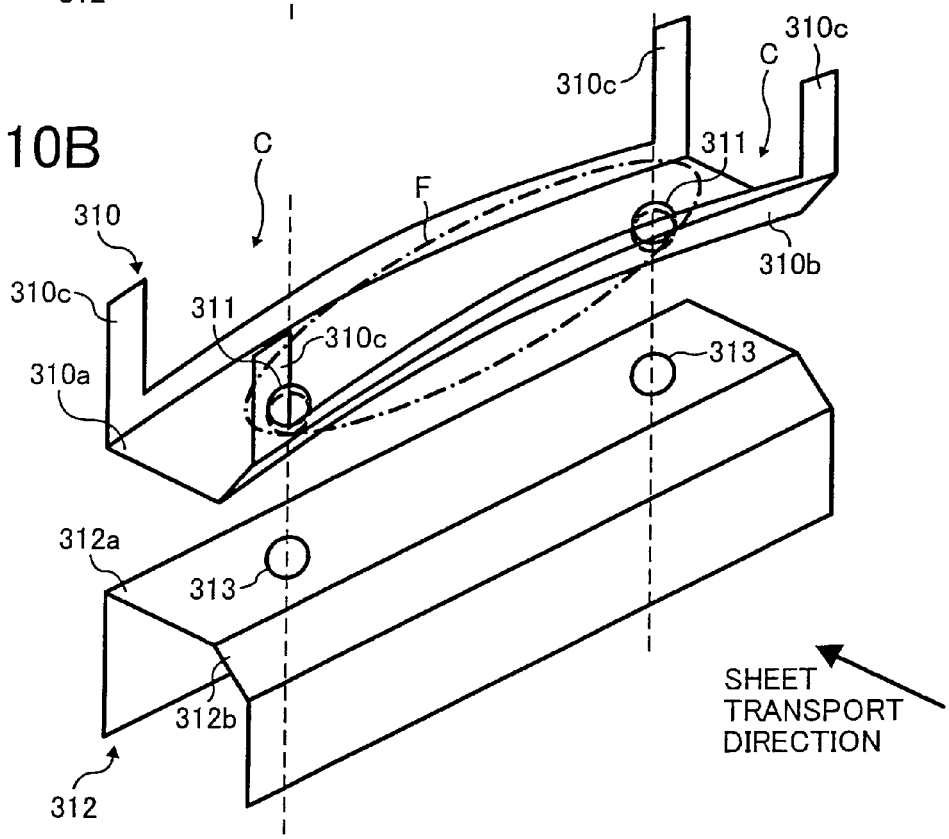

If the cut-off area C is set to the guide frame 310, as shown in FIGS. 10A and 10B, the guide frame 310 may have a smaller face area in the second side face perpendicular to the second main face 310*a*.

In such a case, a bending strength of the second main face 310*a* in a vertical direction with respect to the transport path of sheet P may become smaller than a bending strength of the second main face 310*a* in a parallel direction with respect to the transport path of sheet P.

Hereinafter, such bending strength is explained with reference to FIGS. 9 and 10.

Figure 9A:
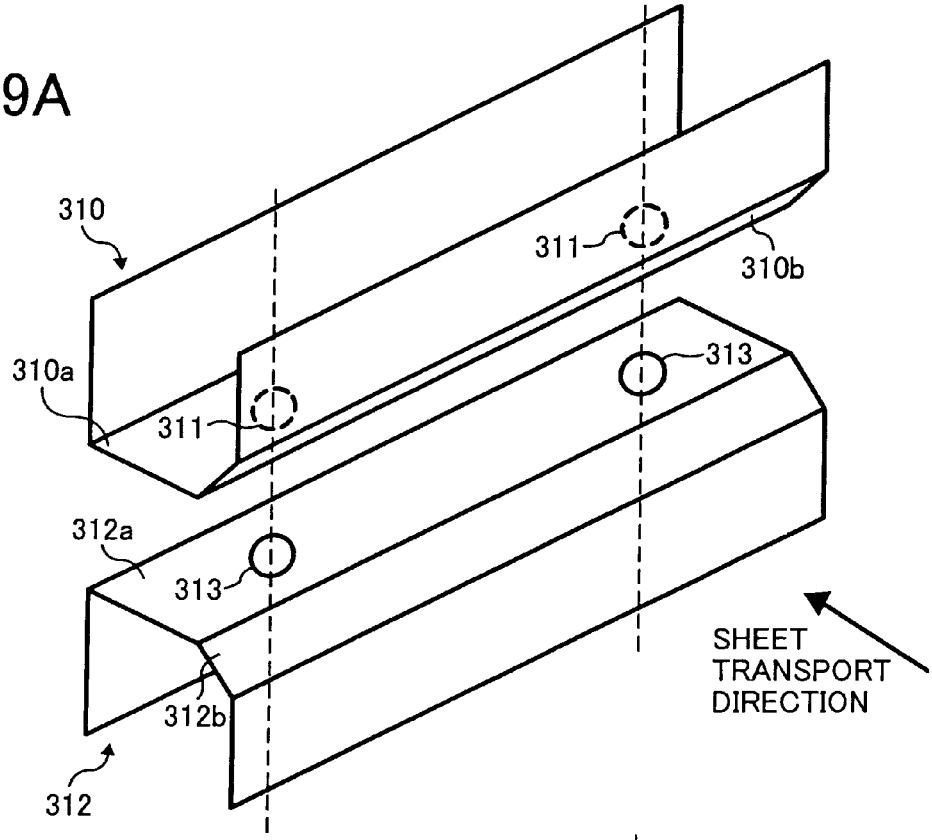
FIGS. 9A and 9B are perspective views of a guide frame and a die frame, in which a guide frame has no cut-off area.
Figure 9B:
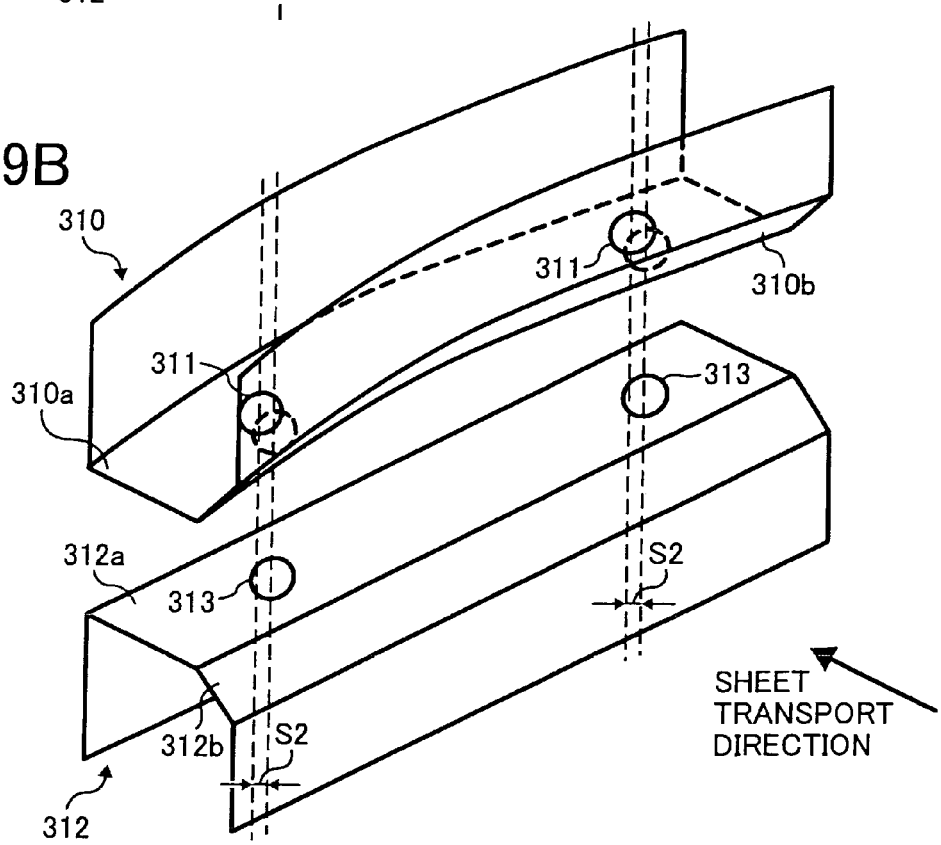

FIGS. 9A and 9B are perspective views of the guide frame 310 and die frame 312, in which the guide frame 310 has no cut-off area.

FIGS. 10A and 10B are perspective views of the guide frame 310 and die frame 312, in which the guide frame 310 has a cut-off area C.

In FIG. 9A, the sheet P has not yet transmitted heat to the guide frame 310. In such a case, the guide frame 310 has a lower temperature, and thereby the guide frame 310 may not deflect.

Accordingly, the guide hole 311 and die hole 313 are aligned on a same axis direction, by which the blade 301 can pass through the guide hole 311 and die hole 313 smoothly.

However, if the sheet P is transported in the perforator 121 and only the guide frame 310 may have a higher temperature the guide frame 310 may deflect significantly compared to the die frame 312.

A deflection caused by such heated sheet P may be observed as warping of a plane having a smaller bending strength in the guide frame 310.

In case of the guide frame 310 having no cut-off area (refer to FIG. 9A), a bending strength of the second main face 310*a* in a parallel direction with respect to the transport path of sheet P may become smaller than a bending strength of the second main face 310*a* in a vertical direction with respect to the transport path of sheet P.

Therefore, as shown in FIG. 9B, the guide frame 310 having no cut-off area may warp in a parallel direction with respect to the transport path of sheet P.

With such warping, the guide hole 311 may deviate from an original position, and the guide hole 311 and the die hole 313 may not align on the same axis direction, which is indicated by a positional deviation S2 in FIG. 9B.

In a condition shown in FIG. 9B, the blade 301 may not pass through the guide hole 311 and the die hole 313 smoothly or the blade 301 cannot pass through the guide hole 311 and the die hole 313.

In view of such drawback, a configuration having a cut-off area C shown in FIG. 10 is employed for the guide frame 310.

FIG. 10A shows the guide frame 310 at a lower temperature.

The guide frame 310 can include a cut-off area C on a second side face 310*c* perpendicular to the second main face 310*a*, as shown in FIG. 10A.

If the cut-off area C is set to the guide frame 310, as shown in FIGS. 10A and 10B, the guide frame 310 may have a smaller face area in the second side face 310*c*, which is perpendicular to the second main face 310*a* of the guide frame 310.

By providing the cut-off area C in the guide frame 310, as shown in FIG. 10A, a bending strength of the second main face 310*a* in a vertical direction with respect to the transport path of sheet P may become smaller than a bending strength of the second main face 310*a* in a parallel direction with respect to the transport path of sheet P.

Therefore, as shown in FIG. 10B, the guide frame 310 may warp in a vertical direction with respect to the transport path of sheet P.

If the second main face 310*a*, indicated by an area F, may warp in a vertical direction with respect to the transport path of sheet P, the guide hole 311 may not substantially deviate from the original position, and the guide hole 311 and the die hole 313 may still align on the same axis direction substantially as shown in FIG. 10B.

In a condition shown in FIG. 10B, the blade 301 may pass through the guide hole 311 and the die hole 313 smoothly.

As such, a condition shown in FIG. 10B may reduce a temperature effect to the guide frame 310, and may suppress the deflection of the second main face 310*a* in a parallel direction with respect to the transport path of sheet P, which may affect the alignment of the guide hole 311 and the die hole 313. Accordingly, an alignment deviation of the guide hole 311 and the die hole 313 may be suppressed.

Furthermore, the heat insulating member 314 may be overlaid on the guide frame 310 as above-mentioned, by which the sheet P may contact the heat insulating member 314 before the sheet P enters a sheet transport path in the perforator 121.

Accordingly, a contact time of the sheet P and guide frame 310 may be reduced when the sheet P enters and passes through the perforator 121, by which a temperature increase of guide frame 310 may be suppressed.

Therefore the heat insulating member 314 may suppress a temperature change of the guide frame 310, by which the deflection of the second main face 310*a* in a vertical direction with respect to the transport path of sheet P may be suppressed.

Accordingly, the alignment deviation of the guide hole 311 and the die hole 313 may be suppressed.

In the above discussed example embodiment, a bending strength of the die frame 312 or guide frame 310 in a parallel direction with respect to the transport path of sheet can be adjusted to a given strength to suppress a deflection of the die frame 312 or guide frame 310 in a parallel direction with respect to the transport path of sheet.

Furthermore, in the above-discussed example embodiment, a contact of sheet P to the die frame 312 or guide frame 310 can be suppressed, by which a temperature increase of the die frame 312 or guide frame 310 can be suppressed.

Accordingly, a temperature variation between the die frame 312 and the guide frame 310 can be suppressed, by which an alignment deviation between the die hole 313 and the guide hole 311 can be suppressed.

The above-described example embodiment can be preferably applied to an image forming apparatus such as printer, copier, facsimile, and MFP (multi-functional peripherals), for example.

Numerous additional modifications and variations are possible in light of the above teachings. It is therefore to be understood that within the scope of the appended claims, the disclosure of the present invention may be practiced otherwise than as specifically described herein.

What is claimed is:

1. A perforator configured to perforate a sheet, comprising:

a first frame including a first main face having a first hole, the first frame being provided under a transport path of the sheet, wherein the first frame includes a first inclined corner extending along the first main face, the first inclined corner being configured to receive the sheet when the sheet enters the perforator;

a heat insulating member disposed on and covering the first inclined corner, the heat insulating member having a lower heat conductivity than the first frame, wherein an edge portion of the heat insulating member protrudes from the first main face into the transport path of the sheet; and a blade configured to be moved into the first hole to perforate the sheet transported in the transport path, wherein the first frame includes a first side face that faces the transport path of the sheet, the first side face being perpendicular to the first main face of the first frame and perpendicular to the transport path of the sheet, and having a center portion and two end portions, wherein a width of the center portion in a vertical direction with respect to the transport path of the sheet is smaller than a width of the end portions in the vertical direction such that a bending strength of the first main face in the vertical direction is smaller than a bending strength of the first main face in a parallel direction with respect to the transport path of the sheet.

2. The perforator of claim 1, wherein the edge portion of the heat insulating member protrudes from the first main face into the transport path of the sheet by a vertical distance in a range of 0.5 mm to 1 mm.

3. The perforator of claim 1, wherein the center portion of the first side face of the first frame is rectangular in shape.

4. A perforator configured to perforate a sheet, comprising:

a first frame including a first main face having a first hole, the first frame being provided under a transport path of the sheet; and a blade configured to be moved into the first hole to perforate the sheet transported in the transport path, wherein the first frame includes a first side face that faces the transport path of the sheet, the first side face being perpendicular to the first main face of the first frame and perpendicular to the transport path of the sheet, and having a center portion and two end portions, wherein a width of the center portion in a vertical direction with respect to the transport path of the sheet is smaller than a width of the end portions in the vertical direction such that a bending strength of the first main face in the vertical direction is smaller than a bending strength of the first main face in a parallel direction with respect to the transport path of the sheet, the perforation further including a second frame, provided over the transport path of the sheet, the second frame including a second main face having a second hole aligned with the first hole in the first main face of the first frame, wherein the blade is configured to be moved into the second hole and the first hole to perforate the sheet; and a transport guide member configured to guide the sheet into a space between the first frame and the second frame, the transport guide member including an upper guide member including an upper guide face; and a lower guide member including a lower guide face, wherein the upper guide face of the upper guide member is positioned below the second main face of the second frame, and the lower guide face of the lower guide member is positioned below the first main face of the first frame.

* * * * *